US007367667B2

(12) United States Patent
Kudoh et al.

(10) Patent No.: US 7,367,667 B2
(45) Date of Patent: May 6, 2008

(54) IMAGE FORMING APPARATUS WITH CONVEYING PART ARRANGED TO ALLOW DRYING

(75) Inventors: Taku Kudoh, Kanagawa (JP); Manabu Nonaka, Kanagawa (JP); Kazumasa Ishikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 131 days.

(21) Appl. No.: 10/941,843

(22) Filed: Sep. 16, 2004

(65) Prior Publication Data

US 2005/0088504 A1 Apr. 28, 2005

(30) Foreign Application Priority Data

Sep. 18, 2003 (JP) ..... 2003-326104

(51) Int. Cl.
*B65H 29/00* (2006.01)

(52) U.S. Cl. ..... 347/104; 400/188; 271/65; 271/186

(58) Field of Classification Search ..... None
See application file for complete search history.

(56) References Cited

U.S. PATENT DOCUMENTS 3,227,444 A * 1/1966 Egan ..... 271/65
4,033,807 A * 7/1977 Neill et al. ..... 156/384
4,066,252 A * 1/1978 Wick ..... 271/3.19
4,307,958 A 12/1981 McIrvine
4,695,898 A 9/1987 Ishikawa et al. ..... 358/296
5,270,738 A * 12/1993 Takahashi et al. ..... 347/24
5,493,365 A 2/1996 Matsui et al. ..... 355/202
5,497,250 A 3/1996 Kawashima ..... 358/498
5,497,986 A 3/1996 Kudo ..... 271/122
5,504,590 A 4/1996 Kawada et al. ..... 358/403
5,610,725 A 3/1997 Kawada et al. ..... 358/403
5,708,517 A 1/1998 Kameyama ..... 358/498
5,737,089 A 4/1998 Kameyama ..... 358/296
5,764,371 A 6/1998 Kawashima et al. ..... 358/405
5,835,232 A 11/1998 Kameyama ..... 358/296
5,847,719 A * 12/1998 Yamaguchi et al. ..... 346/134
5,884,860 A 3/1999 Ishikawa et al. ..... 242/422
5,920,758 A * 7/1999 Ohtsuki ..... 399/405
5,934,661 A 8/1999 Kameyama ..... 271/408
5,961,226 A 10/1999 Nishida ..... 400/70
5,974,298 A * 10/1999 Urban et al. ..... 399/401
5,980,141 A * 11/1999 Donnis ..... 400/625
5,983,054 A 11/1999 Kameyama ..... 399/125
5,986,775 A 11/1999 Yoshimizu ..... 358/496

(Continued)

FOREIGN PATENT DOCUMENTS

EP 1 332 885 A2 8/2003

(Continued)

*Primary Examiner*—Jill E. Culler
(74) *Attorney, Agent, or Firm*—Oblon, Spivak, McClelland, Maier & Neustadt, P.C.

(57) ABSTRACT

An image forming apparatus has a recording head forming an image on paper by jetting ink, a conveying part conveying the paper to a position opposite to said recording head, and a reversing ejection part provided downstream in a paper conveyance direction with respect to the position opposite to the recording head, and said reversing ejection part reversing the paper so that a recorded side thereof on which an image has been recorded may face downward and ejecting the paper on an ejecting table.

25 Claims, 9 Drawing Sheets

U.S. PATENT DOCUMENTS

| | | | | |
|---|---|---|---|---|
| 5,996,990 | A * | 12/1999 | Kawashima | 271/122 |
| 6,000,690 | A | 12/1999 | Kudoh | 271/117 |
| 6,005,687 | A | 12/1999 | Kawashima et al. | 358/498 |
| 6,067,170 | A | 5/2000 | Kawashima et al. | 358/405 |
| 6,079,708 | A | 6/2000 | Fujita | 271/242 |
| 6,128,107 | A | 10/2000 | Kawashima | 358/498 |
| 6,147,781 | A | 11/2000 | Tanaka et al. | 358/498 |
| 6,178,274 | B1 | 1/2001 | Youda et al. | 382/312 |
| 6,182,964 | B1 | 2/2001 | Tanaka et al. | 271/199 |
| 6,295,140 | B1 | 9/2001 | Kameyama | 358/461 |
| 6,311,973 | B1 | 11/2001 | Tanaka et al. | 271/314 |
| 6,349,155 | B1 | 2/2002 | Youda et al. | 382/312 |
| 6,400,472 | B1 | 6/2002 | Yoshimizu | 358/498 |
| 6,416,176 | B1 | 7/2002 | Yasui et al. | |
| 6,457,887 | B1 * | 10/2002 | Wotton et al. | 400/611 |
| 7,093,932 | B2 | 8/2006 | Inokuchi et al. | |
| 2003/0063175 | A1 * | 4/2003 | Nishikawa | 347/104 |

FOREIGN PATENT DOCUMENTS

| | | |
|---|---|---|
| JP | 5-131696 | 5/1993 |
| JP | 5-193213 | 8/1993 |
| JP | 8-110660 | 4/1996 |
| JP | 08-248707 | 9/1996 |
| JP | 10-147025 | 6/1998 |
| JP | 5-63790 | 9/1998 |
| JP | 2000-62259 | 2/2000 |
| JP | 2000-335802 | 12/2000 |
| JP | 2001-136338 | 5/2001 |
| JP | 2003-081516 | 3/2003 |
| JP | 2003-237159 | 8/2003 |

* cited by examiner

IMAGE FORMING APPARATUS WITH CONVEYING PART ARRANGED TO ALLOW DRYING

BACKGROUND OF THE INVENTION

1. Field of the Invention

The present invention relates to an image forming apparatus, and, in particular, to an image forming apparatus used in, for example, a copier, a printer, a facsimile machine, a composite machine or such, and carrying out image forming by jetting recording liquid such as ink on a recording medium such as recording paper.

2. Description of the Related Art

An ink jet recording apparatus used as one of various types of image forming apparatuses such as a printer, a facsimile machine, a copier, a plotter or such includes a serial-type image forming apparatus which has a liquid jetting head (recording head) which jets recording liquid (for example, ink) via microscopic nozzles mounted on a carriage, moves the carriage in a main scanning direction and forms (records) an image on a recording medium (which may be simply referred to as 'sheet' hereinafter, and for which, material thereof is not limited to paper, and the term 'recording medium' is used here to mean even various types of sheets called recording paper, transfer paper, a recording medium or such) with the recording head.

A non-impact recording method is advantageous in terms of a noiseless method in which, even at a time of recording, noise is so small that it may be ignored. Especially, an ink jet recording method is very advantageous recording method in which printing can be carried out at a high speed, and also, printing can be carried out even on a so-called ordinary paper without requiring any special recording liquid (or ink) fixing treatment. Further, for the ink jet recording method, various types of color recording methods employing color ink have been proposed and improved recently.

According to the ink jet recording method, a plurality of colors of ink droplets are made to fly, to be made to adhere to recording paper so as to carry out recording. For this purpose, an ink jet head is used.

Japanese Laid-open Patent Application No. 8-110660 discloses an image forming apparatus having such a type of an ink jet head, for example. This image forming apparatus is roughly shown in FIG. 9. As shown, the image forming apparatus 1 includes a paper supply cassette 3 provided in a bottom part of a body 2 and holding recording paper, a paper supply roller 4 which separates one sheet from the recording paper stored in the paper supply cassette 3 and supplies it, conveying rollers 5 conveying the sheet supplied by the paper supply roller 4, a conveying roller 7 which reverses the paper sheet conveyed by the conveying rollers 5 and supplies it to an ink jet head 6, and ejecting rollers 9 which eject the recording paper on which printing is carried out with the ink jet head 6 to a pressing plate 8 provided at a top part of the body 2.

In this image forming apparatus 1, the ink jet head 6 is disposed above a printing side of the recording paper, jets ink on the recording paper with the use of gravity force naturally applied to the ink itself, and thus, prints on the top side of the recording paper.

However, in the image forming apparatus 1 in the related art, since the ink jet head 6 is disposed above the recording side of the recording paper, and carries out printing on the top side of the recording paper which is then ejected on the pressing plate 8, a subsequent recording paper sheet on which printing is subsequently carried out is ejected on the printed side the recording paper sheet on which printing has been previously carried out. As a result, it is not possible to keep the original page order of the recording paper sheets. Accordingly, it is necessary to correct the page order of the recording paper sheets after the printing thereon by means of the image forming apparatus 1 is finished for all the pages.

SUMMARY OF THE INVENTION

According to an embodiment of the present invention, an image forming apparatus may comprise: a recording head forming an image on a recording medium by jetting recording liquid to the recording medium; a conveying part conveying the recording medium to a position opposite to the recording head; and a reversing ejection part provided downstream in a recording medium conveyance direction with respect to the position opposite to the recording head, and the reversing ejection part reversing the recording medium so that a recorded side thereof on which an image has been recorded may face downward and ejecting the recording medium on an ejecting table.

The ejecting table may be exposed in a zone in which a body of the image forming apparatus is set.

The reversing ejection part may comprise a first conveying member provided on a non-recorded side of the recording medium and a second conveying member provided on a recorded side of the recording medium; the second conveying member comprises a contact member which contacts the recording medium by an area smaller than an area by which the first conveying member contacts the recording medium; and the contact member is provided for a distance required for drying the recording liquid jetted on the recording medium.

The contact member may be provided between the position opposite to the recording head and a position apart from the position opposite to the recording head by the distance downstream in the recording medium conveyance direction.

The reversing ejection part may comprise a first conveying member provided on a non-recorded side of the recording medium and a second conveying member provided on a recorded side of the recording medium; the second conveying member comprises a contact member which contacts the recording medium by an area smaller than an area by which the first conveying member contacts the recording medium; and the contact member is disposed at an interval such as to always hold the recording medium at least two positions along the recording medium conveyance direction between the position opposite to the recording medium and the ejecting table.

The first conveying member may comprise an ejecting roller, and the contact member comprises a spur contacting the ejecting roller.

The ejecting rollers and the spurs may be provided at intervals such as to always hold the recording medium having a minimum size at least two positions along the recording medium conveyance direction.

The contact member may comprise a spur, and the first conveying member, which contacts the spur, comprises an endless belt.

The reversing ejection part may comprise a first conveying member provided on a non-recorded side of the recording medium and a second conveying member provided on a recorded side of the recording medium; the first conveying member may comprise an endless belt conveying the recording medium from the position opposite to the recording head and an absorption force generating part generating an absorption force for sticking the recording medium to the endless belt.

The first conveying member may further comprise a conveying roller provided downstream of the endless belt in the recording medium conveyance direction; and the second conveying member may be provided downstream of the endless belt in the recording medium conveyance direction.

The absorption force generating part may comprise a charging member electrically charging the endless belt to generate electrostatic absorption force.

The second conveying member may comprise spurs arranged at an interval such as to always hold the recording medium at least two positions in the recording medium conveyance direction.

The image forming apparatus may further comprise a drying part configured to dry a recorded side of the recording medium, the drying part being provided downstream of the position opposite to the recording head in the recording medium conveyance direction. The ejecting table may be provided above the recording head.

The image forming apparatus may further comprising a scanner device reading a manuscript, wherein: the scanner device comprises a reading optical system which moves in a lateral direction with respect to the manuscript; and the conveying part and the reversing ejection part convey, reversing, and ejecting the recording medium in the lateral direction.

An image forming apparatus may comprise: a recording head forming an image on a recording medium by jetting recording liquid to the recording medium; a conveying part conveying the recording medium to a position opposite to the recording head; and a reversing ejection part provided downstream in a recording medium conveyance direction with respect to the position opposite to the recording head, and the reversing ejection part reversing the recording medium so that a recorded side thereof on which an image has been recorded may face downward and ejecting the recording medium on an ejecting table, and the ejecting table is provided in an exposed space formed inside a body of the image forming apparatus.

BRIEF DESCRIPTION OF THE DRAWINGS

Other objects and further features of the present invention will become more apparent from the following detailed description when read in conjunction with the accompanying drawings.

DETAILED DESCRIPTION OF THE PREFERRED EMBODIMENTS

Embodiments of the present invention are described with reference to figures.

FIGS. 1 through 4 show an image forming apparatus according to a first embodiment of the present invention. According to the first embodiment of the present invention, the image forming apparatus according to the present invention is applied to a copier as an example. The image forming apparatus according to the present invention may be applied, not only to a copier but also to a printer, a facsimile apparatus, a composite apparatus or such.

Figure 1:
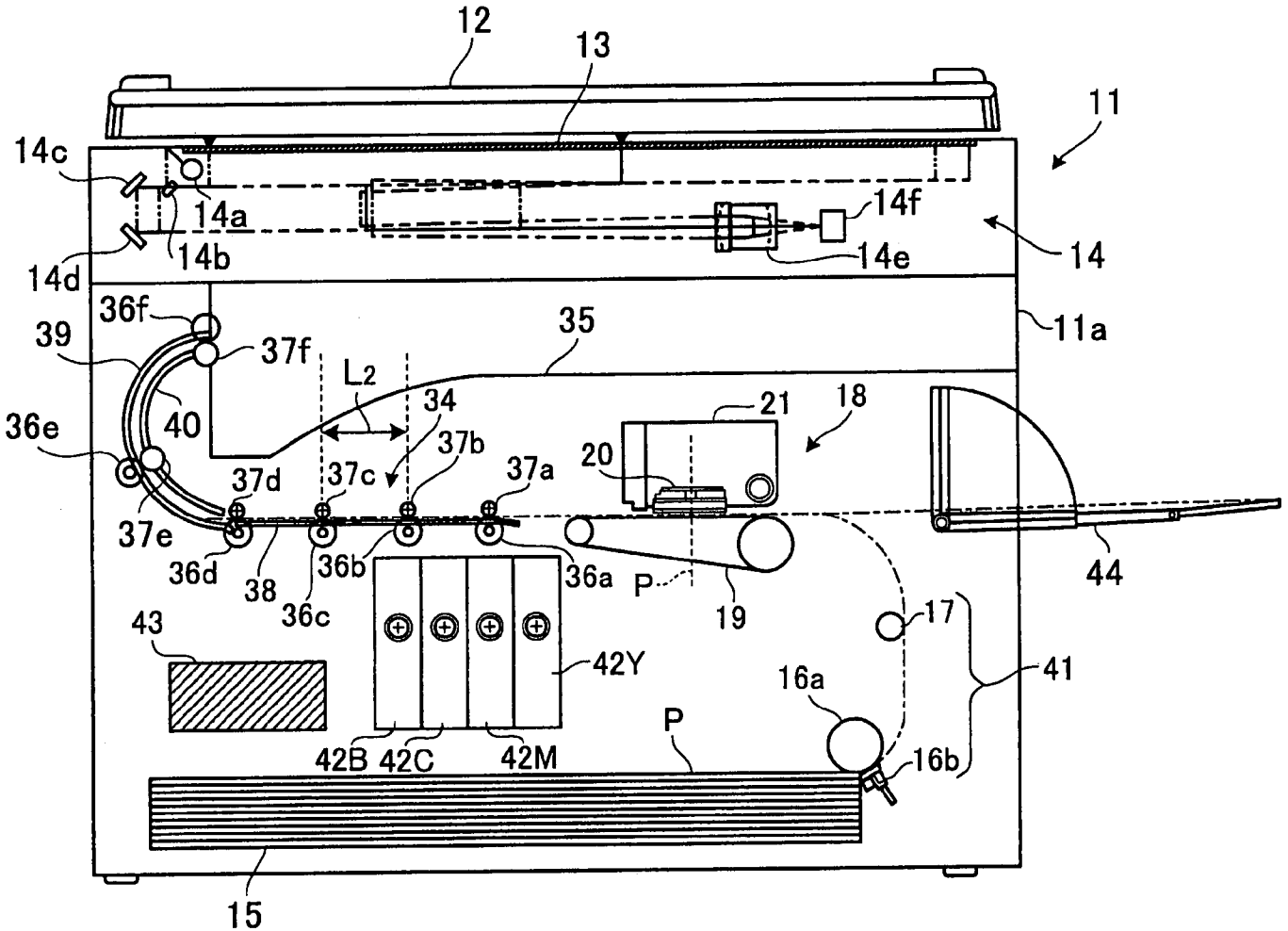
FIG. 1 shows a general configuration of an image forming apparatus according to a first embodiment of the present invention.

First, a configuration is described. As shown in FIG. 1, the copier 11 as the image forming apparatus according to the first embodiment of the present invention includes a pressing plate 12 above a body 11*a*. The pressing plate 12 is mounted on the body 11*a* through a hinge not shown in such a manner that a contact glass 13 provided above the body 12 may be exposed or covered by the pressing plate 12.

The pressing plate 12 is configured to press a manuscript plated on the contact glass 13, and, the manuscript is read by means of a scanner device 14 which is provided below the contact glass 13. The scanner device 14 includes a light source 14*a*, reflective mirrors 14*b*, 14*c* and 14*d*, a focusing lens 14*e*, and an image sensor 14*f* such as a CCD. When the manuscript placed on the contact glass 13 is read, the light source 14*a* and the reflective mirrors 14*b* through 14*d* which act as a reading optical system moves laterally between left and right in the figure with respect to the manuscript.

An optical signal thus input to the CCD 14*f* is then converted into a digital signal, and then is output to a control part 43, which controls a recording liquid jet recording unit 18 described later, based the manuscript reading information thus provided from the scanner device 14.

Instead of the pressing plate 12, an automatic draft feeder which automatically separates a sheet from a sheaf of manuscripts one by one and conveys it to the contact glass 13 may be provided. In such a case, the scanner device 14 reads the manuscript in a condition in which the light source 14*a* and the reflective mirrors 14*b* through 14*d* are fixed.

In a bottom part of the body 11*a*, a recording medium supply cassette 15 holding therein a plurality of recording media (for example, recording paper sheets) P is provided. From the recording medium P held by the recording medium supply cassette 15, the top sheet P thereof is separated by a recording medium supply roller 16*a* and a separating blade 16*b* contacting on the recording medium supply roller 16*a*, and then, is conveyed out by a conveying roller 17 toward an endless belt 19.

A surface of the endless belt 19 is electrically charged by means of an absorption force generating part such as a charging roller so as to act as an electrostatic absorption belt, sticks thereto the recording medium P, and conveys it to the recording liquid jet recording unit 18.

The recording liquid jet recording unit 18 is provided above the endless belt 19, and carries out recording on a top side of the recording medium (such as a recording paper sheet) P as a result of jetting recording liquid (such as ink)

downward thereto. In the first embodiment, the recording medium supply roller 16*a* and the conveying roller 17 act as a conveying part 41.

Figure 2:
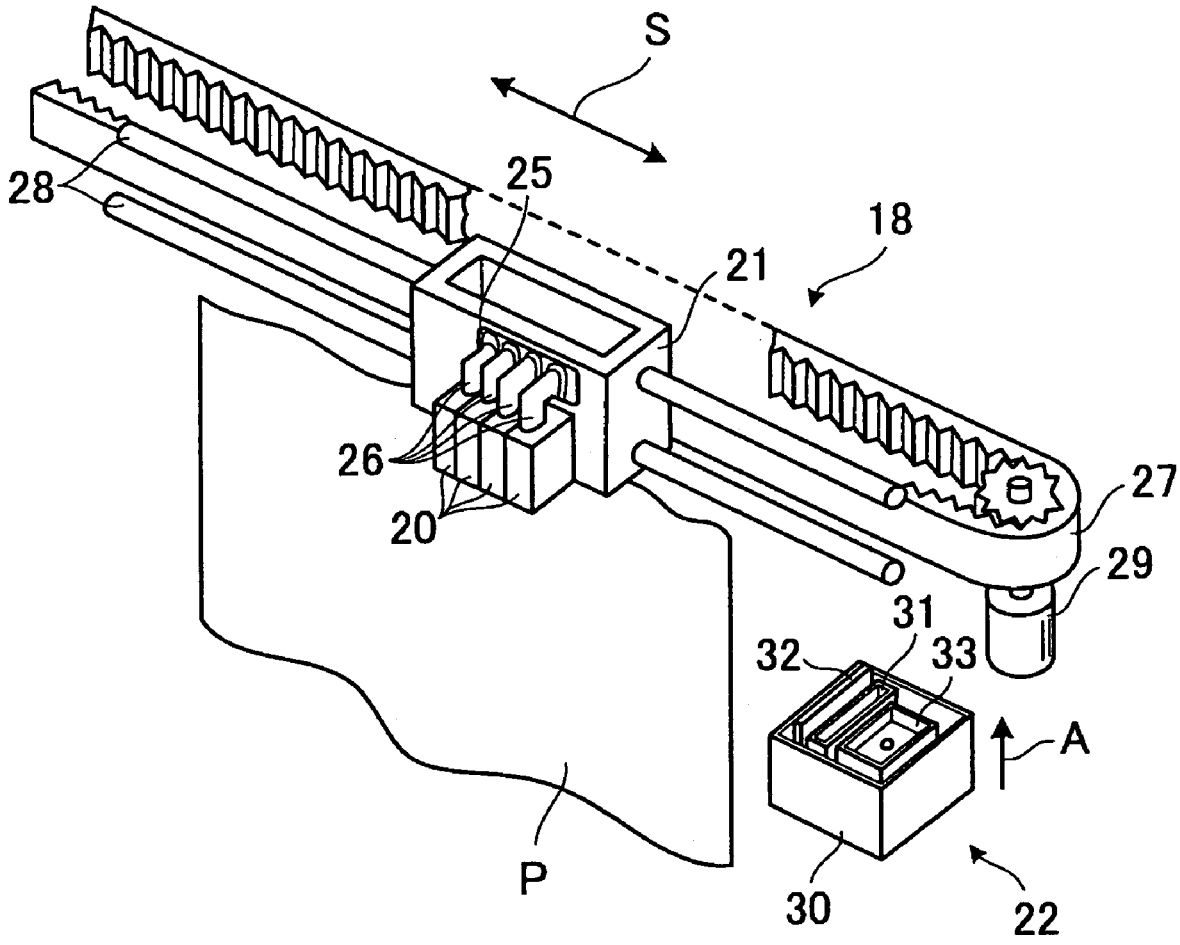
FIG. 2 shows a perspective view of a recording liquid jet recording unit in the first embodiment of the present invention.

FIG. 2 shows the recording liquid jet recording unit 18. As shown, the recording liquid jet recording unit 18 includes a recording liquid jet head 20, a carriage 21, and a reliability maintaining unit 22.

Figure 3:
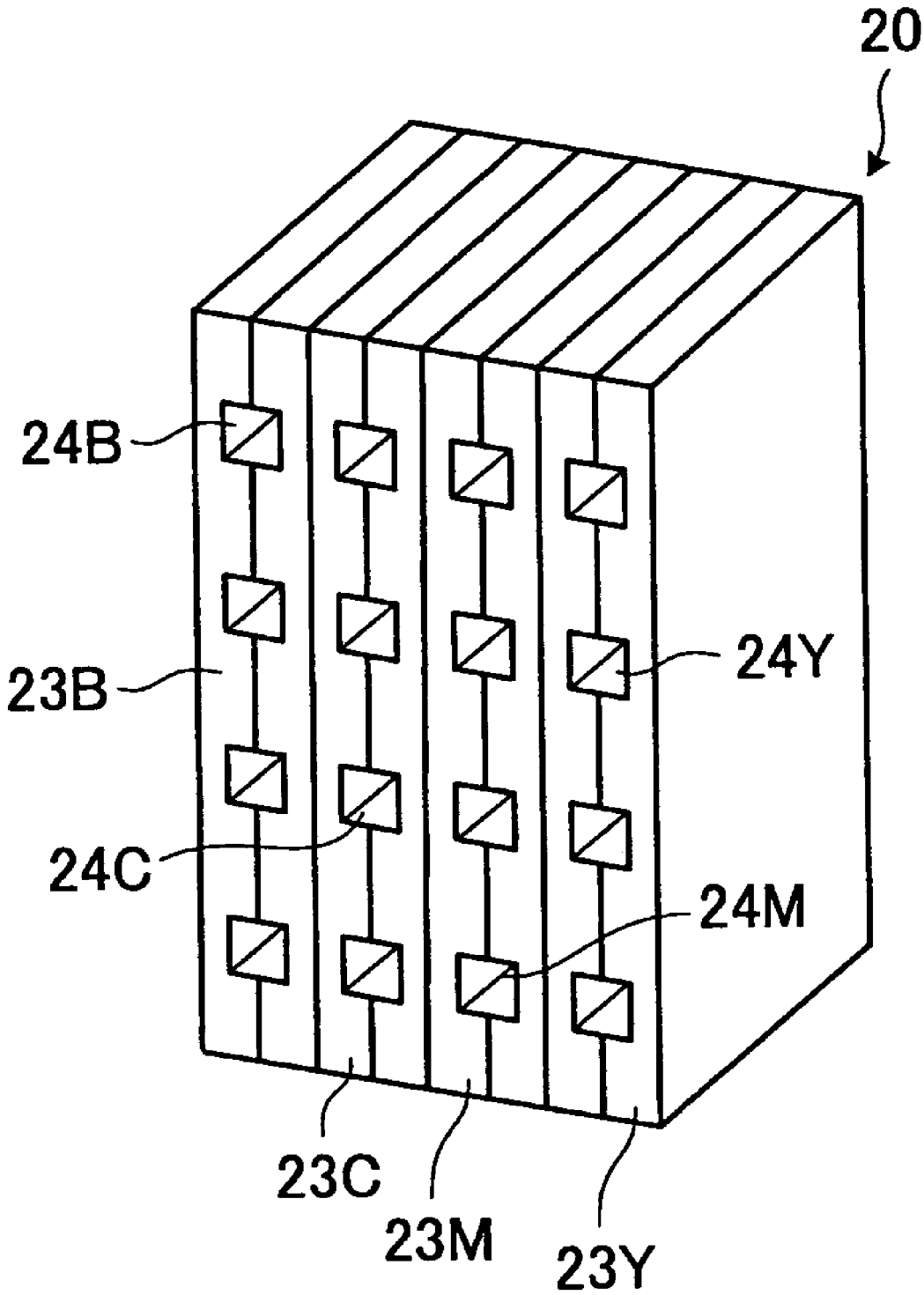
FIG. 3 shows an outer view of a recording liquid jet head in the first embodiment of the present invention.

In the recording liquid jet head 20, as shown in FIG. 3, recording heads 23B, 23C, 23M and 23Y are integrated into one unit. In the recording heads 23B, 23C, 23M and 23Y, a plurality of orifices 24B, 24C, 24M and 24Y which jet recording liquid droplets of respective colors of black (B), cyan (C), magenta (M) and yellow (Y) are arranged along an approximately same plane. Thus, the recording liquid jet head 20 according to the present embodiment is a color recording liquid jet head. Further, the recording heads 23B, 23C, 23M and 23Y have recording liquids of the respective colors supplied thereto from recording liquid tanks 42B, 42C, 42M and 42Y, as shown in FIG. 1, respectively.

Further, inside of each of the recording heads 23B, 23C, 23M and 23Y, a common liquid chamber is provided. In a case of a thermal type described below, a heating resistance element is provided along a wall of a liquid path which communicates between the common liquid chamber and the orifices 24*b*, 24C, 24M or 24Y, for generating energy for jetting the recording liquid.

As a type of the recording liquid jet head 20, other than the above-mentioned thermal type, a piezo type, an electrostatic type or such may be applied. According to the piezo type, a piezo device is used as a pressure generating means (actuator means) pressing recording liquid contained in the recording liquid path (pressure generation chamber). Actually, a vibration plate including the piezo device which forms the wall of the recording liquid path is deformed, the volume of in the recording liquid path is changed, and thereby, a recording liquid droplet is jetted.

According to the above-mentioned thermal type, the heating resistance element is used to heat the recording liquid in the recording liquid path, a bubble is generated therein, and, the pressure of the bubble results in a recording liquid droplet being jetted. According to the electrostatic type, a vibration plate forming the wall of the recording liquid path and an electrode are disposed to be opposite to one another, the vibration plate is deformed by means of electrostatic force generated between the vibration plate and the electrode, a volume in the recording liquid path is changed, and thereby, a recording liquid droplet is jetted.

As the recording liquid jet head 20, a line-type head may be applied in which such a number of nozzles as to correspond to a length of the recording medium (paper or such) in a width direction thereof (i.e., a direction perpendicular to a recording medium conveyance direction) are provided. In this case, the recording liquid jet head 20 is produced in such a manner that a cartridge which holds the recording liquid and the recording liquid jet head which jets recording liquid droplets are integrated into one unit, and is mounted in a head holder, not shown.

Further, the recording liquid recording head 20 in the line type described above has a plurality of heads which jet recording liquid droplets in the respective colors of yellow, magenta, cyan and black, for example, in the stated order from the upstream side in the recording medium conveyance direction. As the head in the line type, a head in which a plurality of nozzles jetting droplets of the respective colors are arranged at predetermined intervals may also be used instead. Further, one in which the head and the recording liquid cartridge are separately provided may also be used instead.

The control part 43 drives (energizes) the relevant heating resistance element, in a case of the above-mentioned thermal type, according to an image signal, the recording liquid in the liquid chamber is thereby film boiled, and at this time, recording liquid is jetted from the orifices of 24B, 24C, 24M or 24Y, as mentioned above.

A printed circuit board 25 is provided in the carriage 21 for controlling recording liquid jetting operation carried out by means of the recording liquid jet head 20. This printed circuit board 25 is connected with the control part 43, and also, is connected with the recording liquid jet head 20 by means of a flexible cable 26.

The carriage 21 is coupled to a driving belt 27, and also, is slideably mounted on a guide rail 28. The control part 43 operates a motor 29, and therewith, drives the driving belt 27 shown in FIG. 2 between a front side and a rear side in FIG. 1 in the body 11*a*. Thereby, the carriage 21 moves in a direction S in FIG. 2, which is a main scanning direction of the recording medium P, along the guide rail 28.

At this time, as a result of recording liquid being jetted from the orifices 24B, 24C, 24M or 24Y of the recording head 23B, 23C, 23M or 23Y, recording is carried out on a recording side of the recording medium P. In a case where recording is carried out in a monochrome manner, only the recording head 23B is driven, and recording liquid is jetted from the orifices 24B. The orifices 24B, 24C, 24M or 24Y jetting recording liquid in each color are arranged in a direction perpendicular to the main scanning direction in the recording liquid jet head.

The reliability maintaining unit 22 is provided on a front side of the body 11*a* in which the carriage 21 stands ready, and, is located below the recording liquid head 20 when the recording liquid head 20 has been moved to a standby position.

The reliability maintaining unit 22 includes a body 30, a collecting hole 31 provided in the body 30 for collecting unnecessary recording liquid after recording liquid jetting which is not used for actual recording is carried out, a blade 32 provided for removing recording liquid stain, other stain such as paper waste, dust or such, and a cap member 33 for shutting the orifices 24B, 24C, 24M and 24Y at a time of standby, and also, absorbing recording liquid from the orifices 24B, 24C, 24M and 24Y by means of a vacuum pump or such not shown.

The recording medium P on which recording has been carried out by means of the recording liquid jet recording unit 18 is conveyed out by means of the endless belt 19 toward a reversing ejection part 34 provided downstream of the recording liquid jet recording unit 18. The reversing ejection part 34 has a function of reversing the recording medium P so as to cause the recorded side thereof to face downward, and ejecting the recording medium P to an ejecting table 35 provided at an ejecting position above the recording liquid jet recording unit 18. In other words, the ejecting table 35 is exposed inside of a zone in which the body 11*a* is set, and is provided between the scanner device 14 and the recording liquid jet recording unit 18, as shown in FIG. 1. The ejecting table 35 is provided in an exposed space formed inside a body 12 of the image forming apparatus. The exposed space is formed between the scanner device 14 and the recording liquid jet recording unit 18.

Because the reversing ejection part 34 has a function of reversing the recording medium P so as to cause the recorded side thereof to face downward, a page order of the recording media such as paper sheets may be kept properly.

Figure 4:
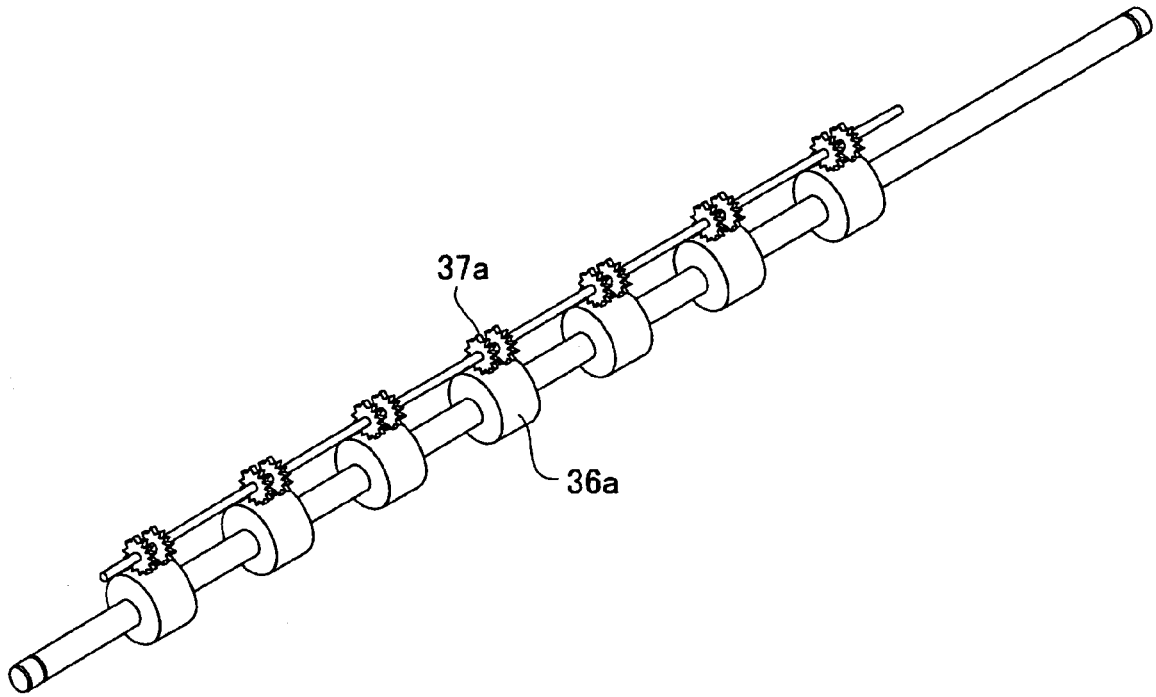
FIG. 4 shows a perspective view of spurs and ejecting rollers.

This reversing ejection part 34 is provided on a non-recorded side of the recording medium P, has a plurality of ejecting rollers (first conveying members) 36*a* through 36*f* which contact the recording medium P, spurs (second conveying members, or contact members) 37*a* through 37*d* and ejecting rollers 37*e* and 37*f* (second conveying members) provided on a recorded side of the recording medium P. The spurs 37*a* through 37*d* have a function of conveying the recording medium P in cooperation with the ejecting rollers 36*a* through 36*d* as shown in FIG. 4. The ejecting roller 37*e* and 37*f* contacts the ejecting rollers 36*e* and 36*f*, respectively. The respective spurs 37*a* through 37*d* are provided in such a manner that two spurs are provided for each one roller included in each line of the ejecting rollers 36*a* through 36*d*, as shown in FIG. 4. Each line of spurs 37*a* through 37*d* are rotatably supported by a single rotational shaft as shown.

Respective rotational shafts such as that shown in FIG. 4 are pressed toward the side of the rejecting rollers 36*a* through 36*d* by means of springs or such, so that the spurs 37*a* through 37*d* may be positively made to contacts the ejecting rollers 36*a* through 36*d*, respectively.

Further, on the side of the non-recorded side of the recording medium P, as shown in FIG. 1, linear guide plate 38 and a curved guide plate 39 adjacent to the linear guide plate 38 and reversing the recording medium P upside down are provided. On the side of the recorded side of the recording medium P, a curved guide plate 40 is provided opposite to the curved guide plate 39.

According to the present embodiment, the spurs 37*a* through 37*d* are provided on the side of the recoded side of the recording medium P, which have contact areas to the recording medium P smaller than those of the ejecting rollers 36*a* through 36*d*, between the recording position and a position apart therefrom by a predetermined distance downstream in the recording medium P conveyance direction. The spurs 37*a* through 37*d* are provided for the predetermined distance that is required for drying the recording liquid jetted on the recording medium P.

This is because, in consideration of a time required for drying the recording liquid jetted on the recording medium P, the conveying members are prevented from contacting the recording medium P by wide areas until the recording liquid thereon is dried. The guide plate 38 has slits, and the ejecting rollers 36*a* through 36*d* project above the guide plate 38 via the slits and then contact the spurs 37*a* through 37*d* as shown in FIG. 4.

Specifically, assuming that L denotes a distance between the recording position P and the spurs 37*d*, V denotes a conveyance speed of the recording medium P, and t denotes a time interval required for dryness of the recording liquid, and assuming that the time interval t required for dryness of the recording liquid is 1 second, the distance L toward the spurs 37*d* should be determined according to a relation of $L/V>t$.

Therefore, in a zone within the distance L up to a position for which the recording liquid is being dried, the spurs 37*a* through 37*d* are provided on the side of the recorded side of the recording medium P, and, in a conveyance system in a zone in which the recording liquid has been dried, the ejecting rollers 36*e*, 36*f*, 37*e* and 37*f* are provided. Thereby, it is possible to prevent the recording liquid jetted on the recording medium P from being transferred to the spurs 37*a* through 37*d*.

Further, the ejecting rollers 36*a* through 36*d* and spurs 37*a* through 37*d* are provided at intervals such that the recording medium P having the minimum size may be always held therebetween at front and rear two positions in the recording medium conveyance direction.

Specifically, assuming that a manuscript having the minimum size has a size of L1, and each interval between adjacent ones of the ejecting rollers 36*a* through 36*d* and the spurs 37*a* through 37*d* is L2 (see FIG. 1), a relation of $2L2<L1$ should be satisfied. According to the present embodiment, assuming that L1=139 mm, L2 is set as 50 mm.

Further, according to the present embodiment, the ejecting rollers 36*a* through 36*f*, the spurs 37*a* through 37*d* and the ejecting rollers 37*e* and 37*f* convey the recording medium P in a lateral direction (left and right direction in FIG. 1) which is the same direction in which the light source 14*a* and the reflective mirrors 14*b* through 14*d* move as mentioned above. Therefore, the respective rotational axes of the ejecting rollers 36*a* through 36*f*, the spurs 37*a* through 37*d* and the ejecting rollers 37*e* and 37*f* are set in a direction (i.e., a direction perpendicular to FIG. 1) perpendicular to the recording medium P conveyance direction. Further, a manual insertion tray 44 is provided on a side wall of the body 11*a* as shown in FIG. 1. This manual insertion tray 44 is folded to be accommodated in the body 11*a* when it is not used, while, it is made to project from the body 11*a* as shown in FIG. 1 when it is used for an operator to manually insert a recording medium P for the recording liquid jet recording unit 18.

In the first embodiment of the present invention having the configuration described above, after recording is carried out on the recording medium P by means of the recording liquid jet recording unit 18, the recording medium P is conveyed out from the recording position P by means of the endless belt 19. This recording medium P is then held from both sides by the ejecting rollers 36*a* and the spurs 37*a*, after that, is held from both sides by the ejecting rollers 36*b* through 36*d* and the spurs 37*b* through 37*d*, in sequence, and thus, is conveyed therewith.

Then, after the recording medium P is held from both sides by the ejecting rollers 36*e* and 36*f* and the ejecting rollers 37*e* and 37*f*, and then is reversed upside down along the guide plates 39 nad 40, the recording medium P is ejected on the ejecting table 35 above the body 11*a* in a state in which the recorded side thereof faces downward accordingly. After that, a subsequent recording medium P is ejected on the non-recorded side of the preceding recording medium P in a state in which a recorded side thereof faces downward in the same manner.

Thus, according to the present embodiment, the reversing ejection part 34 which reverses the recording medium P upside down so that the recorded side thereof may face downward, and then ejects it on the ejecting table 35, is provided downstream of the recording liquid jet recording unit 18, and the ejecting table 35 is provided at the ejecting position exposed within the zone in which the body 11*a* is set. Accordingly, a subsequent recording medium P is ejected on the non-recorded side of the preceding recording medium P in a state in which a recorded side thereof faces downward. As a result, the page order of the recording media P (such as recording paper sheets) can be kept properly.

Furthermore, since the recording medium P is ejected on the ejecting table 35 exposed within the zone in which the body 11*a* is set, it is not necessary to provide an ejecting table which projects from the body 11*a* externally, and as a result, it is possible to effectively avoid increase in a space required for setting the copier 11.

Furthermore, the spurs 37*a* through 37*d* are provided on the side of the recorded side of the recording medium P through the predetermined distance L from the recording liquid jet recording unit 18 downstream in the recording medium P conveyance direction in consideration of dryness of the recording liquid jetted for carrying out recording on the recording medium P. Thereby, it is possible to prevent the recording liquid not yet dried from being transferred to the spurs 37*a* through 37*d*, and thus, to avoid deterioration in recording performance.

Furthermore, according to the present embodiment, the ejecting rollers 36*a* through 36*d* and the spurs 37*a* through 37*d* are provided at intervals such as to always hold from both sides even the recording medium P of the minimum size at front and rear two positions along the recording medium P conveyance direction. Accordingly, even such members as the spurs 37*a* through 37*d* which have reduced thickness and have small contact areas with respect to the recording medium to convey therewith are employed, it is possible to improve performance for conveying the recording medium P, and also, to avoid generation of skew in the recording medium P during the conveyance.

Further, according to the present embodiment, since the ejecting table 35 is provided above the recording liquid jet recording unit 18, an operator can take the recording medium P at a position higher in the copier 11, and thus, workability in taking out the recording medium P is improved.

Furthermore, in the first embodiment of the present invention, the scanner device 14 having the light source 14*a* and the reflective mirrors 14*b* through 14*d* which move in the lateral direction with respect to the manuscript to read is provided, and the conveying part 41 and the reversing ejection part 34 which convey the recording medium P in the same lateral direction, then reverse and eject it, are provided. Accordingly, it becomes not necessary to increase the body 11*a* in the depth direction, and also, it becomes not necessary to project the recording medium supply cassette 15 from the body 11*a*. Furthermore, although it is necessary to increase the size of the body 11*a* in the lateral direction, it is possible to avoid deterioration in overall appearance when the body 11*a* and the scanner device 14 are combined, since the scanner device 14 has an increased size also in the lateral direction.

That is, in a case where a large recording medium such as recording paper with a standard size of A3 were conveyed in the depth direction, the body 11*a* should have been increased in the depth size. In such a case, when it is necessary to provide the light source 14*a* and the reflective mirrors 14*b* through 14*d* which move in the lateral direction, the scanner device 14 having the thus increased size in the lateral direction should be set although the depth size of the body 11*a* were increased as mentioned above. Accordingly, overall appearance may have been deteriorated. Furthermore, if the recording medium supply cassette were projected from the body 11*a* in front thereof, it would not be necessary to increase the depth size of the body 11*a*. However, in such a case, the thus-projecting recording medium supply cassette may become obstacle. All of these problems can be solved according to the present embodiment.

Further, in the present embodiment, a drying means such as a dryer may be provided downstream in the recording medium P conveyance direction with respect to the recording liquid jet recording unit 18, for forcibly drying the recorded side of the recording medium P. In this case, since it is possible to forcibly dry the recorded side of the recording medium P by means of the dryer or such, it is possible to rapidly fix the recording liquid onto the recording medium P.

Figure 5:
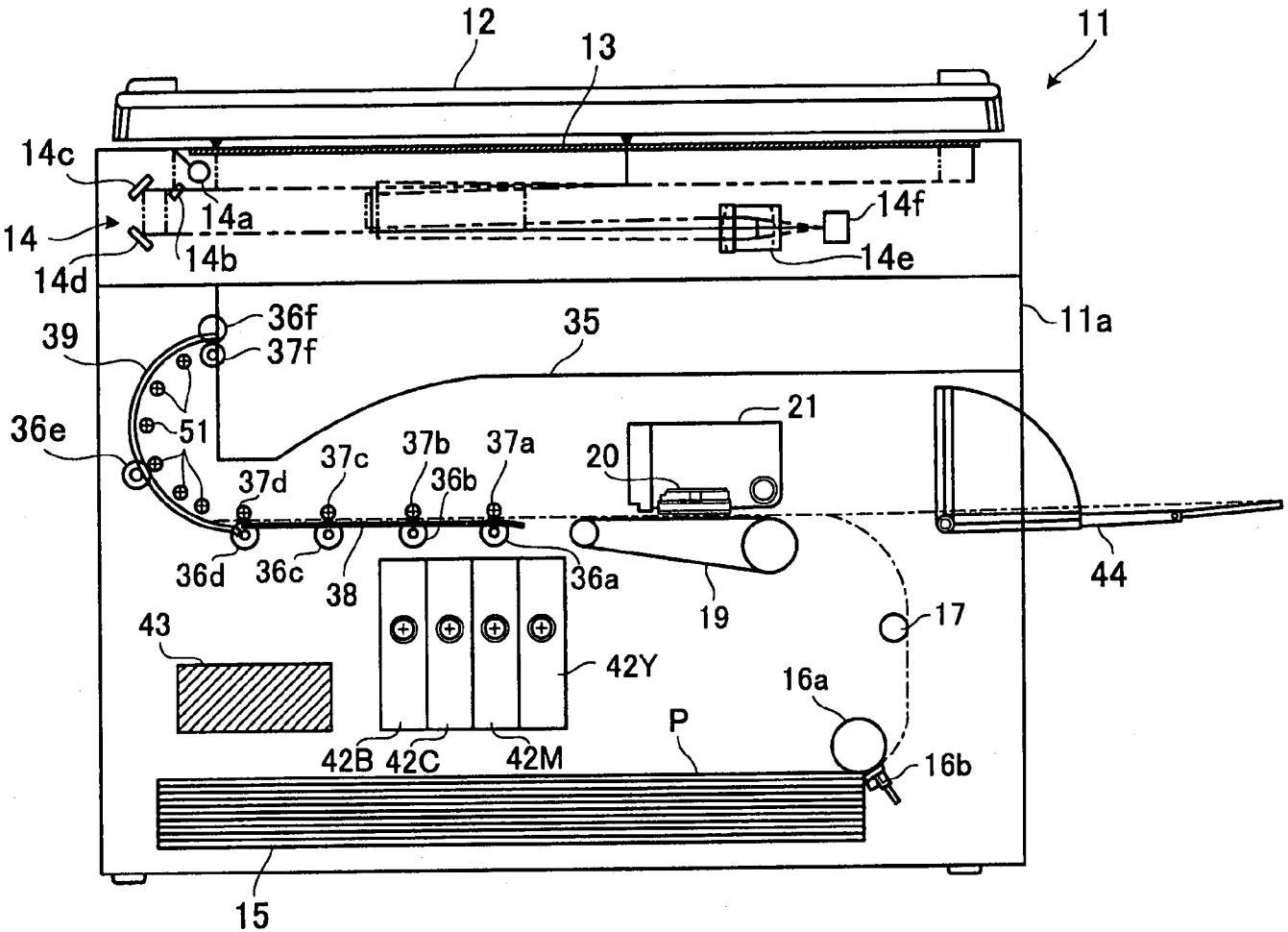
FIG. 5 shows a general configuration of an image forming apparatus according to a second embodiment of the present invention.

FIG. 5 shows an image forming apparatus according to a second embodiment of the present invention. The same reference numerals are given to parts/components identical to those in the first embodiment described above, and duplicated description therefor is omitted.

According to the second embodiment, spurs 51 are provided in a zone downstream of the spurs 37*d* through the ejecting rollers 36*f*, as shown. These spurs 51 are deposed at intervals so narrow as to always hold the recording medium P of the minimum size at front and rear two positions along the conveyance direction.

According to the second embodiment, since the configuration is provided as mentioned above, in addition to the advantages obtained from the first embodiment, since the spurs 51 are provided at intervals so narrow as to always hold the recording medium P of the minimum size at front and rear two positions along the conveyance direction of the recording medium P from the recording liquid jet recording unit 18 through the ejecting rollers 36*f*, it becomes not necessary to provide a guide plate for guiding the recording medium P on the side of the recorded side of the recording medium P in the zone from the recording liquid jet recording unit 18 through the ejecting table 35. Therefore, it is possible to prevent the recording liquid not yet fixed from being transferred to the guide plate due to a contact of the recorded side of the recording medium P to the guide plate.

Figure 6:
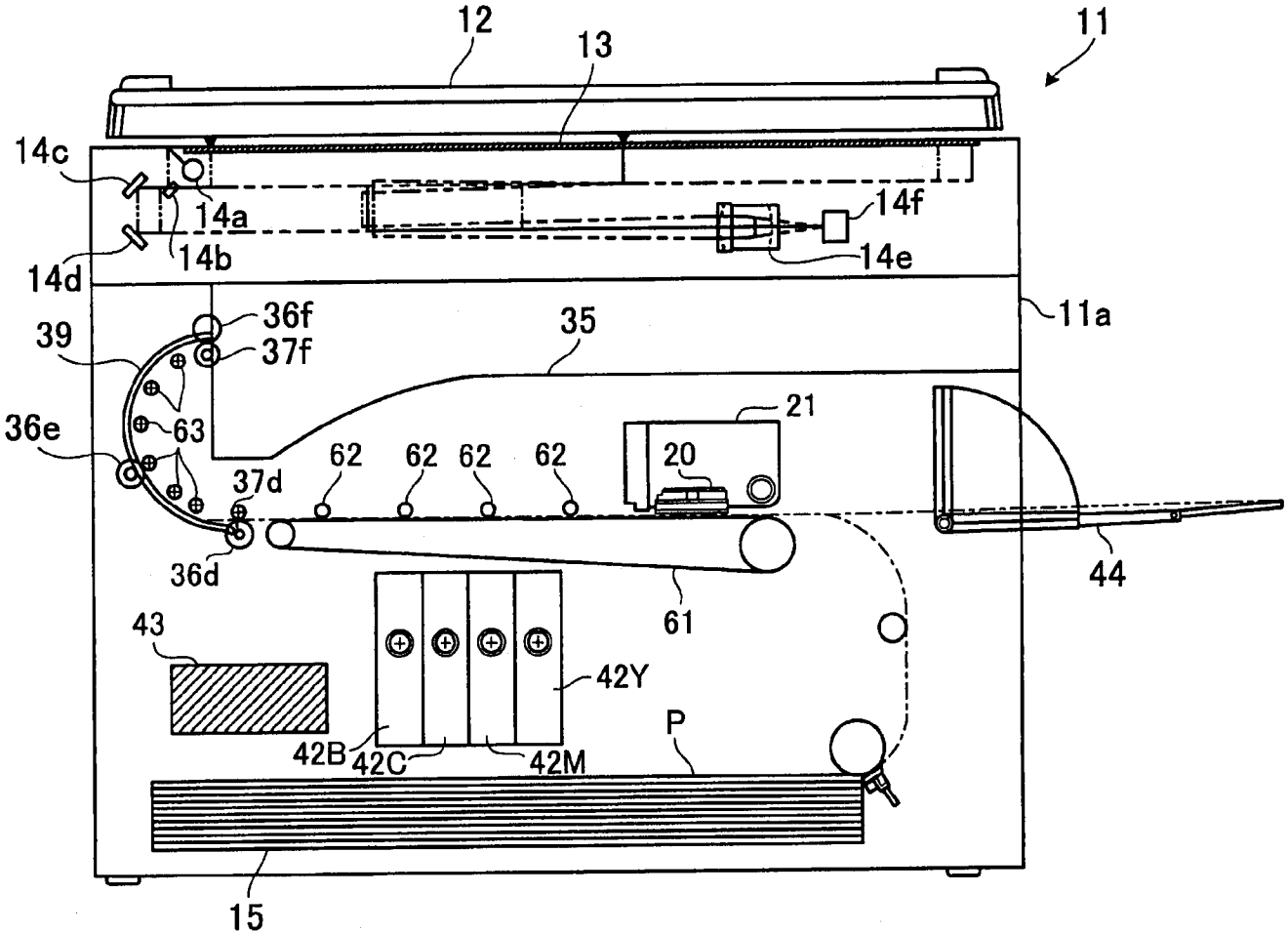
FIG. 6 shows a general configuration of an image forming apparatus according to a third embodiment of the present invention.

FIG. 6 shows an image forming apparatus according to a third embodiment of the present invention. The same reference numerals are given to parts/components identical to those of the first embodiment, and duplicated description therefor is omitted.

According to the third embodiment, instead of the ejecting rollers 36*a* through 36*c* in the first embodiment, an endless belt 61 is provided as a first conveying member. This endless belt 61 is an electrostatic absorption belt having a surface thereof electrically charged by means of a predetermined charging unit not shown. A plurality of spurs 62 contacts the endless belt 61, and contacts the recorded side of the recording medium P by reduced areas.

Further, spurs 63 are provided in a zone downstream of the spurs 37*d* through the ejecting rollers 37*f*, and are disposed at intervals so narrow as to always hold the recording medium P of the minimum size at front and rear two positions along the conveyance direction.

According to the third embodiment, after recording is carried out by means of the recording liquid jet recording unit 18 on the recording medium P, the recording medium P is conveyed out from the recording position by means of the endless belt 61 and the spurs 62. After that, the recording medium P is held from the both sides by means of the ejecting rollers 36*e* and the spurs 63, and is reversed upside down, while being conveyed along the guide plate 39. Then, after that, the recording medium P is held from both sides by means of the ejecting rollers 36*f* and the ejecting rollers 37*f*, and is ejected on the ejecting table 35 above the body 11*a* in a state in which the recorded side thereof faces downward. After that, a subsequent recording medium P is ejected on the non-recorded side of the preceding recording medium P in a state in which a recorded side thereof faces downward.

Thus, according to the third embodiment, since the first conveying member includes the endless belt 61, it is possible to avoid deterioration in the recording medium P conveyance performance even in a state in which the spurs 62 are employed to contacts the endless belt 61 for the purpose of guiding the conveyance.

Figure 7:
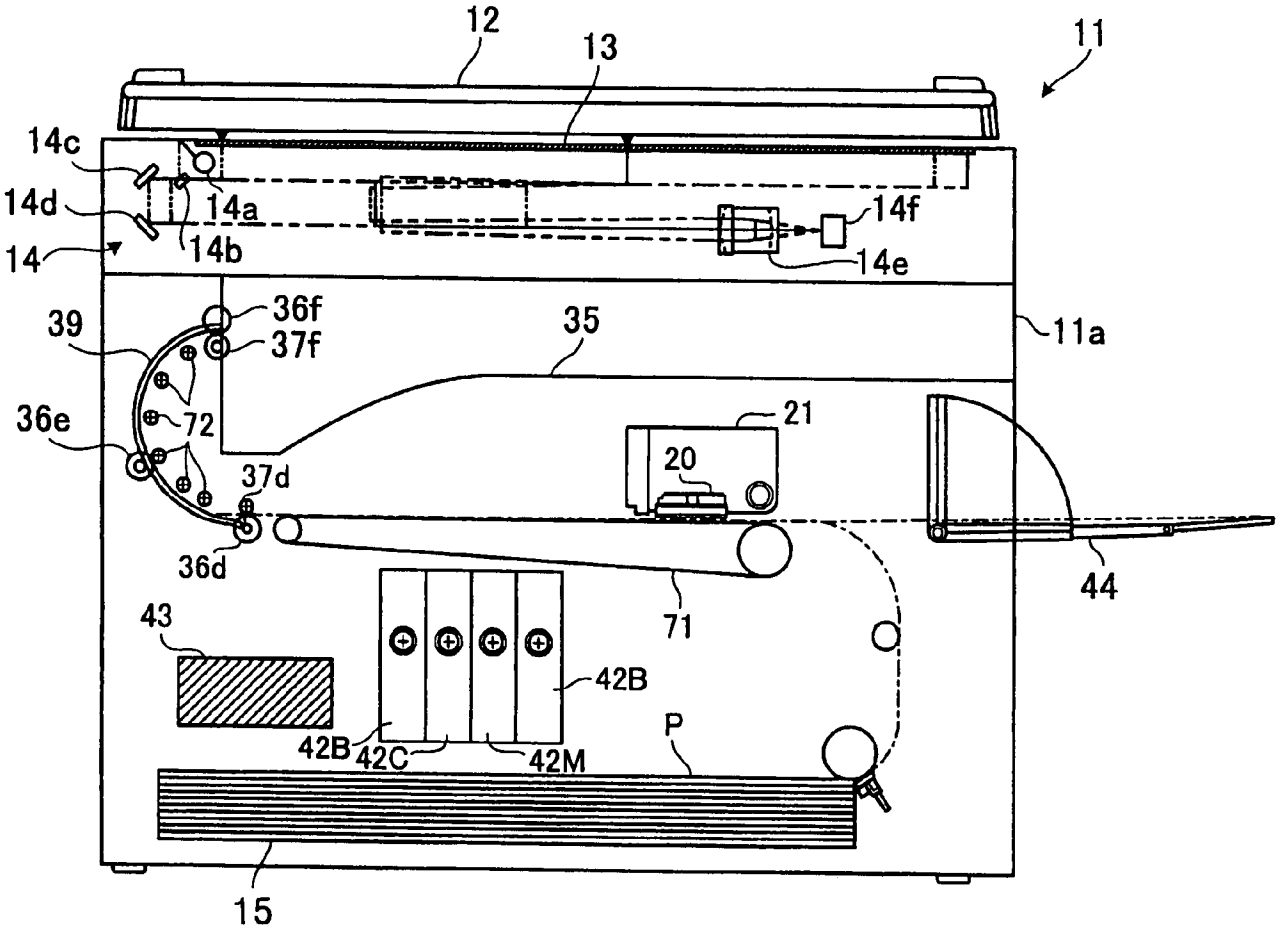
FIG. 7 shows a general configuration of an image forming apparatus according to a fourth embodiment of the present invention.

FIG. 7 shows an image forming apparatus according to a fourth embodiment of the present invention. The same reference numerals are given to parts/components identical to those in the first embodiment, and duplicated description therefor is omitted.

According to the fourth embodiment, instead of the ejecting rollers 36*a* through 36*c* in the first embodiment, an endless belt 71 is provided as a first conveying member. This endless belt 71 is an electrostatic absorption belt having a surface thereof electrically charged by means of a predetermined absorption force generating unit such as a charging roller or such not shown. A plurality of spurs 72 are provided downstream of the spurs 37*d* through the ejecting rollers 37*f*, and are disposed at intervals so narrow as to always hold the recording medium of the minimum size at front and rear two positions along the conveyance direction.

According to the fourth embodiment, after recording is carried out by means of the recording liquid jet recording unit 18 on the recording medium P, the recording medium P is conveyed out from the recording position by means of the endless belt 71 while the recording medium P is stuck to the endless belt 71 by means of the above-mentioned electrostatic force. After that, the recording medium P is held from the both sides by means of the ejecting rollers 36*e* and the spurs 72, is reversed upside down while being conveyed along the guide plate 39. Then, after that, the recording medium P is held from both sides by means of the ejecting rollers 36*f* and the ejecting rollers 37*f*, and is ejected on the ejecting table 35 above the body 11*a* in a state in which the recorded side thereof faces downward. After that, a subsequent recording medium P is ejected on the non-recorded side of the preceding recording medium P in a state in which a recorded side thereof faces downward.

Thus, according to the fourth embodiment, since the non-recorded side of the recording medium P is stuck to the endless belt 71 and the recording medium P is conveyed therewith, it is possible to omit provision of spurs at a position opposite to the endless belt 71. Accordingly, it is possible to positively prevent the recording liquid not yet fixed from being transferred to such a contact member, and thus to avoid deterioration in recording performance.

Figure 8A:
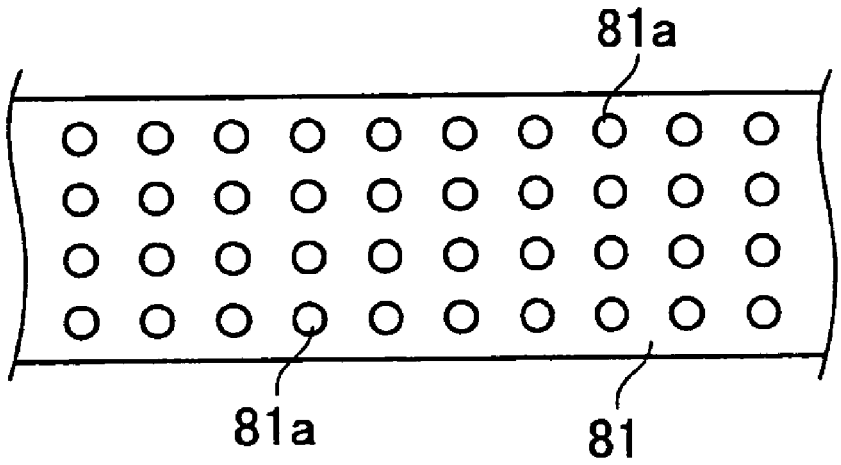
FIGS. 8A and 8B show a plan view and a side elevational view of an endless belt in another configuration of the fourth embodiment of the present invention, respectively.
Figure 8B:
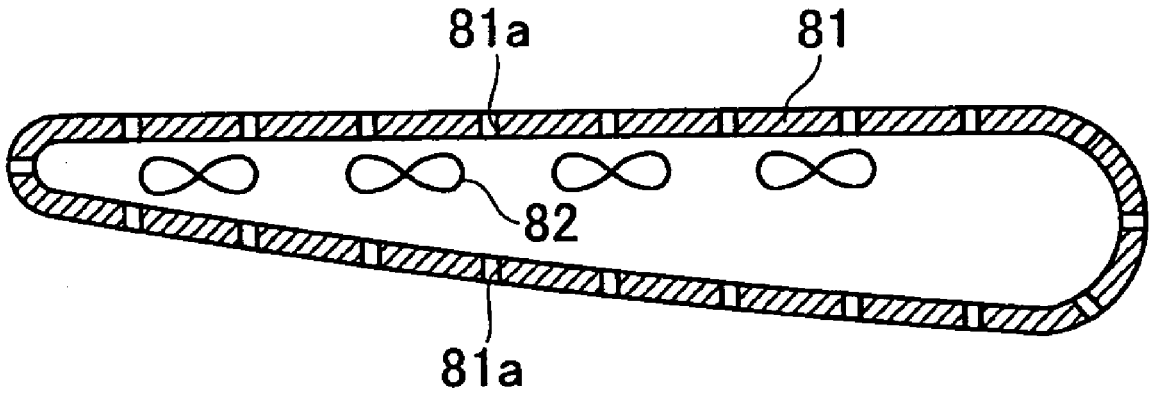
Figure 9:
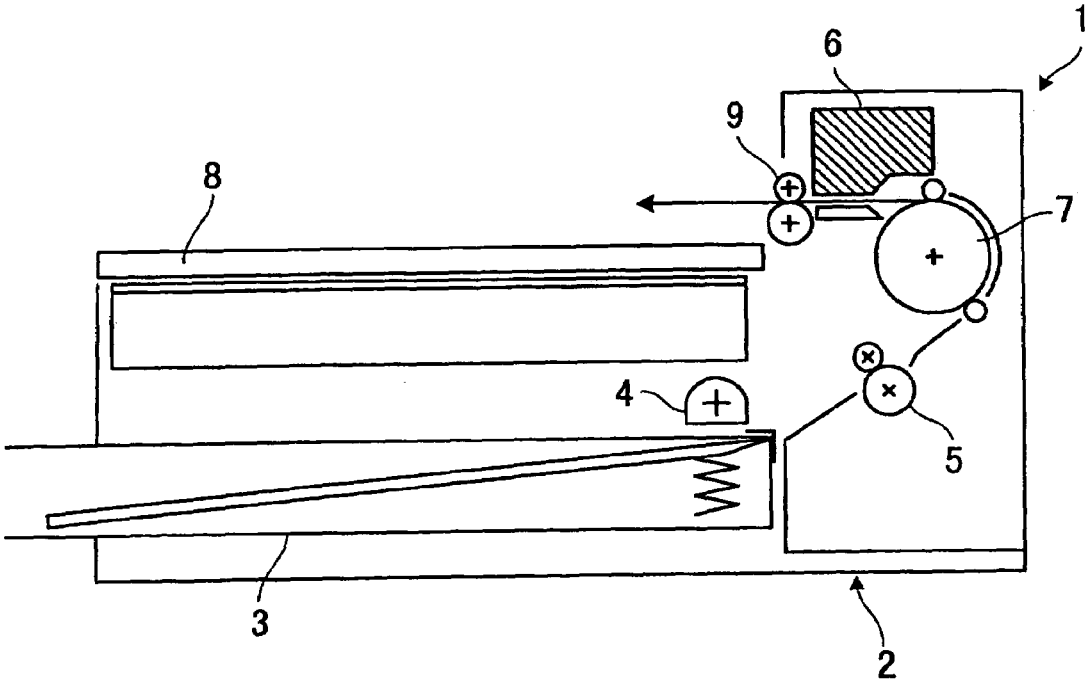
FIG.9 Background Art
FIG. 9 shows a general configuration of an image forming apparatus in the related art.

As the above-mentioned absorption force generating unit, instead of providing the endless belt 71 which is the electrostatic belt, an endless belt shown in FIGS. 8A and 8B may be employed. As shown in FIGS. 8A and 8B, the endless belt 81 has a plurality of opening through holes 81*a* provided therein, and also, absorption fans 82 are built in the endless belt 81. By driving the absorption fans 82, the recording medium P is absorbed through the opening through holes 81*a*, and therewith, is stuck to the endless belt 81.

By providing such a configuration, the first conveying member is configured by the endless belt having a wide area, and also, it is possible to stick the recording medium P to the endless belt 81. Accordingly, even when the spurs are employed as the second conveying members, or even provision thereof is omitted, deterioration in recording medium conveying performance can be avoided. Furthermore, since the non-recorded side of the recording medium P is directly stuck to the endless belt 81 by means of the absorption force of the absorption fans 82, it is possible to dry the recording liquid not yet fixed from the rear side of the recording medium P. As a result, it is possible to fix the recording liquid rapidly.

Thus, according to an image forming apparatus according to the present invention, a recording medium is ejected in a state in which a recorded side thereof faces downward, and thereby, an order of pages of the recording media is kept properly. Accordingly, the present invention is advantageous as being applied to an image forming apparatus or such, such as a copier, a printer, a facsimile apparatus, a composite machine or such, in which image forming is carried out as a result of recording liquid being jetted to a recording medium.

Although the embodiments of the present invention have been described assuming that an image forming apparatus according to the present invention is applied as ones in a multi-function (MFP) type, it is also possible to apply the present invention in the same manner to an image forming apparatus in an another type, or, to an image forming apparatus employing recording liquid other than ink.

Although not particularly mentioned, at least the ejecting rollers 36*a* through 36*f* acting as the conveying members for conveying the recording medium P in the respective embodiments are appropriately driven by a driving unit such as a motor not shown for the purpose of actively conveying the recording medium P.

Further, the present invention is not limited to the above-described embodiments, and variations and modifications may be made without departing from the basic concept of the present invention claimed.

The present application is based on Japanese Priority Applications Nos.2003-326104, filed on Sep. 18, 2003, the entire contents of which are hereby incorporated herein by reference.

What is claimed is:

1. An image forming apparatus comprising:

a recording head configured to form an image on a recording medium and configured to jet recording liquid to the recording medium to produce a liquid jetted recording;

a conveying part conveying the recording medium to a position opposite to said recording head;

a reversing ejection part provided downstream in a recording medium conveyance direction with respect to the position opposite to the recording head, and said reversing ejection part being configured to reverse the recording medium so that a recorded side of the recording medium on which an image has been recorded faces downward and configured to eject the recording medium on an ejecting table; and said reversing ejection part including:

a substantially horizontal linear guide and a curved guide adjacent to the substantially horizontal linear guide configured to reverse the recording medium upside down; and said substantially horizontal linear guide including:

a first conveying member provided on a non-recorded side of the recording medium; and a second conveying member provided on a recorded side of the recording medium, and said second conveying member including a contact member configured to contact the recording medium by an area smaller than an area by which said first conveying member is configured to contact the recording medium;

wherein $L/V>t$, where L is a distance from a recording position to where the curved guide begins, V is a conveyance speed of the recording medium, and t is a time period required to achieve a dryness of the recording liquid.

2. The image forming apparatus as claimed in claim 1, wherein:

said ejecting table is exposed in a zone in which a body of the image forming apparatus is set.

3. The image forming apparatus as claimed in claim 1, wherein:

said contact member is provided between said position opposite to the recording head and a position apart from said position opposite to the recording head by said distance downstream in the recording medium conveyance direction.

4. The image forming apparatus as claimed in claim 1, wherein:

said contact member is disposed at an interval configured to hold the recording medium at least two positions along the recording medium conveyance direction between the position opposite to the recording medium and the ejecting table.

5. The image forming apparatus as claimed in claim 4, wherein:

said first conveying member comprises ejecting rollers, and said contact member comprises spurs contacting the ejecting rollers.

6. The image forming apparatus as claimed in claim 5, wherein:

the ejecting rollers and the spurs are provided at intervals and are configured to hold the recording medium having a minimum size at least two positions along the recording medium conveyance direction.

7. The image forming apparatus as claimed in claim 4, wherein:

said contact member comprises spurs, and the first conveying member, which contacts the spurs, comprises an endless belt.

8. The image forming apparatus as claimed in claim 1, wherein:

said first conveying member comprises ejecting rollers, and said contact member comprises spurs contacting the ejecting rollers.

9. The image forming apparatus as claimed in claim 8, wherein:

the ejecting rollers and the spurs are provided at intervals and are configured to hold the recording medium having a minimum size at least two positions along the recording medium conveyance direction.

10. The image forming apparatus as claimed in claim 1, wherein:

said contact member comprises a spur, and the first conveying member, which contacts the spur, comprises an endless belt.

11. The image forming apparatus as claimed in claim 1, wherein:

said first conveying member comprises an endless belt configured to convey the recording medium from the position opposite to the recording head and an absorption force generating part configured to generate an absorption force configured to stick the recording medium to the endless belt.

12. The image forming apparatus as claimed in claim 11, wherein:

said first conveying member further comprises a conveying roller provided downstream of the endless belt in the recording medium conveyance direction; and said second conveying member is provided downstream of the endless belt in the recording medium conveyance direction.

13. The image forming apparatus as darned in claim 11, wherein:

said absorption force generating part comprises a plurality of opening through holes formed in the endless belt and an absorption fan built in the endless belt.

14. The image forming apparatus as claimed in claim 11, wherein:

said absorption force generating part comprises a charging member configured to electrically charge the endless belt to generate electrostatic absorption force.

15. The image forming apparatus as claimed in claim 11, wherein:

said second conveying member comprises spurs arranged at an interval which are configured to hold the recording medium at least two positions in the recording medium conveyance direction.

16. The image forming apparatus as claimed in claim 1, further comprising a drying part configured to dry a recorded side of the recording medium, the drying part being provided downstream of the position opposite to the recording head in the recording medium conveyance direction.

17. The image forming apparatus as claimed in claim 1 wherein:

said ejecting table is provided above said recording head.

18. The image forming apparatus as claimed in claim 1, further comprising a scanner device configured to read a manuscript, wherein:

said scanner device comprises a reading optical system configured to move in a lateral direction with respect to the manuscript; and said conveying part and the reversing ejection part are configured to convey, reverse, and eject the recording medium in the lateral direction.

19. The image forming apparatus as claimed in claim 1, wherein: said contact member of the substantially horizontal linear guide is provided so as to extend for a distance necessary for drying the liquid jetted on the recording medium.

20. An image forming apparatus comprising:

a recording head configured to form an image on a recording medium and configured to jet recording liquid to the recording medium to produce a liquid jetted recording;

a conveying part conveying the recording medium to a position opposite to said recording head;

a reversing ejection part provided downstream in a recording medium conveyance direction with respect to the position opposite to the recording head, and said reversing ejection part configured to reverse the recording medium so that a recorded side of the recording medium on which an image has been recorded faces downward and configured to eject the recording medium on an ejecting table, said ejecting table is provided in an exposed space formed inside a body of the image forming apparatus, and said reversing ejection part including:

a substantially horizontal linear guide and a curved guide adjacent to the substantially horizontal linear guide configured to reverse the recording medium upside down; and said substantially horizontal linear guide including:

a first conveying member provided on a non-recorded side of the recording medium; and a second conveying member provided on a recorded side of the recording medium, and said second conveying member including a contact member which is configured to contact the recording medium by an area smaller than an area by which said first conveying member is configured to contact the recording medium; and wherein $L/V>t$ where L is a distance from a recording position to where the curved guide begins, V is a conveyance speed of the recording medium, and t is a time period required to achieve a dryness of the recording liquid.

21. The image forming apparatus as claimed in claim 20, further comprising a scanner device configured to read a manuscript, said scanner device being provided above said ejecting table, and said ejecting table being provided in an area formed by said scanner device.

22. An image forming apparatus according to claim 21, wherein:

the curved guide begins at a most downstream spur at a downstream end of the substantially horizontal linear guide.

23. An image forming apparatus according to claim 20, wherein:

the curved guide begins at a most downstream spur at a downstream end of the substantially horizontal linear guide.

24. An image forming apparatus comprising:

a recording head configured to form an image on a recording medium and configured to jet recording liquid to the recording medium to produce a liquid jetted recording;

a conveying part configured to convey the recording medium to a position opposite to said recording head; and a reversing ejection part provided downstream in a recording medium conveyance direction with respect to the position opposite to the recording head, said reversing ejection part being configured to reverse the recording medium so that a recorded side of the recording medium on which an image has been recorded faces downward, and being configured to eject the recording medium to an ejecting table, said reversing ejection part including a substantially horizontal linear guide and a curved guide adjacent to the substantially horizontal linear guide configured to reverse the recording medium upside down, wherein $L/V>t$ where L is a distance from a recording position to where the curved guide begins. V is a conveyance speed of the recording medium, and t is a time period required to achieve a dryness of the recording liquid.

25. An image forming apparatus according to claim 24, wherein:

the curved guide begins at a most downstream spur at a downstream end of the substantially horizontal linear guide.

* * * * *